US012747687B2

(12) United States Patent
Akiyama et al.

(10) Patent No.: US 12,747,687 B2
(45) Date of Patent: Sep. 29, 2026

(54) ENGINE COOLING SYSTEM

(71) Applicant: TOYOTA JIDOSHA KABUSHIKI KAISHA, Toyota (JP)

(72) Inventors: Shoichi Akiyama, Toyota (JP); Tatsunobu Murai, Okazaki (JP); Sohichi Imai, Toyota (JP); Rihito Kaneko, Miyoshi (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 19/216,010

(22) Filed: May 22, 2025

(65) Prior Publication Data

US 2026/0085627 A1 Mar. 26, 2026

(30) Foreign Application Priority Data

Sep. 25, 2024 (JP) ..... 2024-166235

(51) Int. Cl.
*F01P 7/16* (2006.01)
*F01P 7/14* (2006.01)

(52) U.S. Cl.
CPC ..... *F01P 7/164* (2013.01); *F01P 2007/146* (2013.01)

(58) Field of Classification Search
CPC ... F01P 7/164; F01P 2007/146; F01P 2060/08
See application file for complete search history.

(56) References Cited

U.S. PATENT DOCUMENTS 4,628,872 A * 12/1986 Ogawa ..... F01P 5/14 165/41
2017/0203635 A1 7/2017 Kuroda et al.

FOREIGN PATENT DOCUMENTS

| | | | | |
|---|---|---|---|---|
| CN | 102086801 A * | 6/2011 | ..... | F01P 7/167 |
| CN | 104602927 A * | 5/2015 | ..... | B60L 58/26 |
| CN | 205064075 U * | 3/2016 | | |
| DE | 102011116387 A1 * | 4/2013 | ..... | B60H 1/00492 |
| JP | 2014080123 A * | 5/2014 | | |
| WO | WO-2013114874 A1 * | 8/2013 | ..... | B60H 1/00278 |
| WO | WO-2014034062 A1 * | 3/2014 | ..... | B60L 1/02 |
| WO | 2016/059791 A1 | 4/2016 | | |

* cited by examiner

*Primary Examiner* — Hung Q Nguyen
(74) *Attorney, Agent, or Firm* — SoraIP, Inc.

(57) ABSTRACT

An engine cooling system includes a cooling circuit including a circulation path circulating coolant between an engine and a heater core for heating, by an engine water pump causing coolant to flow to the engine and a heater core water pump causing coolant to flow to the heater core; and a controller controlling the engine water pump and the heater core water pump. The controller includes a first control unit controlling the heater core water pump so a correlation value correlated with lift of the heater core water pump is no greater than an upper limit value where step-out of the engine water pump is suppressible when a drive request is made for the engine water pump when stopped, and a second control unit starting driving the engine water pump when the heater core water pump is controlled so the correlation value is no greater than the upper limit value.

3 Claims, 6 Drawing Sheets

ENGINE COOLING SYSTEM

CROSS-REFERENCE TO RELATED APPLICATION

This application claims priority to Japanese Patent Application No. 2024-166235 filed on Sep. 25, 2024. The disclosure of the above-identified application, including the specification, drawings, and claims, is incorporated by reference herein in its entirety.

BACKGROUND

1. Technical Field

The present disclosure relates to an engine cooling system.

2. Description of Related Art

There is an engine cooling system that is equipped with a cooling circuit that includes a circulation path through which coolant is circulated, between an engine and a heater core for heating, by a water pump (e.g., see WO 2016/059791).

SUMMARY

There are cases in which an engine water pump and a heater core water pump that cause coolant to flow through the engine and the heater core, respectively, are provided. When driving of the engine water pump is started in a state in which the heater core water pump is being driven, there is a concern that the engine water pump might exhibit step-out due to pressure of coolant that is conveyed from the heater core water pump. There is concern that this might reduce controllability of the engine water pump.

Accordingly, an object of the present disclosure is to provide an engine cooling system that suppresses step-out of an engine water pump.

The above object can be achieved by an engine cooling system including

- a cooling circuit including a circulation path through which coolant circulates between an engine and a heater core for heating, by an engine water pump that causes coolant to flow to the engine and a heater core water pump that causes coolant to flow to the heater core, and
- a control device that controls the engine water pump and the heater core water pump, in which
- the control device includes
  - a first control unit for controlling the heater core water pump such that a correlation value that is correlated with lift of the heater core water pump is no greater than an upper limit value at which step-out of the engine water pump is suppressible when a drive request is made for the engine water pump in a stopped state, and
  - a second control unit that starts driving the engine water pump in a state in which the heater core water pump is controlled such that the correlation value is no greater than the upper limit value.

The cooling circuit may include a radiator path that communicates with the circulation path and through which coolant from the engine is made to flow to a radiator without passing through the heater core, and a thermostat that is provided on the radiator path,

- the control device may include a setting unit for setting the upper limit value, and
- when the thermostat is in a fully closed state, the setting unit may set the upper limit value to a lower value than when the thermostat is in a fully open state.

The cooling circuit may include an on and off valve that adjusts an opening degree of the circulation path, and

- the setting unit may set the upper limit value to a higher value as the opening degree is smaller.

An engine cooling system that suppresses step-out of an engine water pump can be provided.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Figure 1:
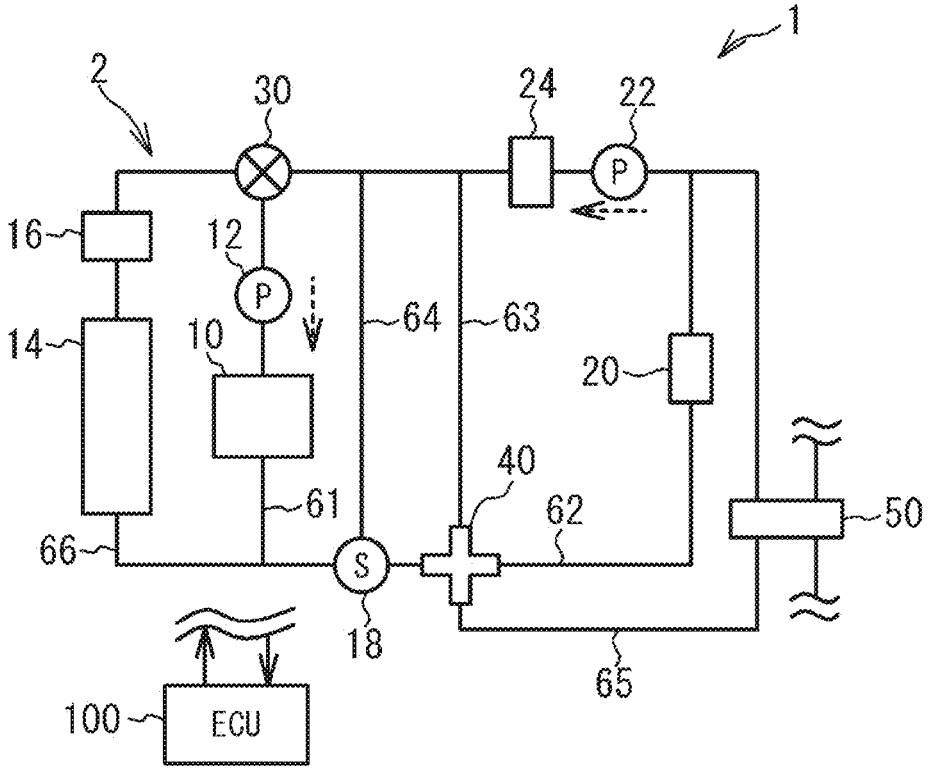
FIG. 1 is an illustration of an engine cooling system.

FIG. 1 is an explanatory diagram of an engine cooling system 1. The engine cooling system 1 is mounted on a vehicle, for example. The engine cooling system 1 includes an engine cooling circuit 2 and an ECU (Electronic Control Unit 100). The engine cooling circuit 2 includes an engine 10, an engine water pump (hereinafter referred to as an EWP) 12, a radiator 14, a reserve tank 16, a temperature sensor 18, a heater core 20, a heater core water pump (hereinafter referred to as an HWP) 22, a heater 24, a thermostat 30, a four-way valve 40, and a heat exchanger 50.

The engine 10 is a driving power source of the vehicle. EWP 12 is an electric water pump that supplies coolant to the engine 10 by making the coolant flow toward the engine 10 in the direction indicated by the arrow in FIG. 1. The radiator 14 cools the coolant by exchanging heat between the coolant and air outside the vehicle. The reserve tank 16 stores excess coolant. The heater core 20 heats the vehicle cabin by using the heat of the coolant. HWP 22 is an electric water pump that sucks the coolant from the heater core 20 in the direction indicated by the arrow in FIG. 1, thereby causing the coolant to flow through the heater core 20. The heater 24 heats the coolant when the temperature of the coolant is insufficient with respect to the heating in the vehicle cabin by the heater core 20.

Thermostat 30, the temperature of the coolant flowing into the thermostat 30 is fully closed state is less than the first temperature, the temperature of the coolant flowing into the thermostat 30 is the second temperature higher than the first temperature is fully opened state. In the thermostat 30, the temperature of the coolant flowing into the thermostat 30 is equal to or higher than the first temperature and is lower than the second temperature, and the opening degree increases as the temperature of the coolant increases. For example, before the completion of warm-up of the engine 10, the temperature of the coolant flowing into the thermostat 30 is lower than the first temperature, and after the completion of warm-up, the temperature of the coolant flowing into the thermostat 30 becomes equal to or higher than the second temperature. The flow path of the coolant in the fully closed state and the fully opened state of the thermostat 30 will be described in detail later.

The four-way valve 40 allows the coolant to flow through a predetermined path, which will be described in detail later, by switching the communication states of the four paths. The four-way valve 40 includes a rotor rotatably housed in a housing and an actuator for driving the rotor. The communication states of the four paths are switched according to the rotational position of the rotor controlled by the actuator.

The heat exchanger 50 exchanges heat between the coolant flowing through the engine cooling circuit 2 and the coolant flowing through a battery cooling circuit for cooling a battery (not shown).

ECU 100 is an electronic control unit including an arithmetic processing unit that performs various arithmetic processing related to travel control of vehicles, and a memory that stores control programs and data. ECU 100 obtains the temperature of the coolant based on the temperature sensor 18. ECU 100 controls the rotational speeds of EWP 12 and HWP 22, the current flow rate of the heaters 24, and the communication state of the four-way valve 40 according to the operating state of the engine 10, the heating request, and the cooling request of the battery. ECU 100 functionally realizes a first control unit, a second control unit, and a setting unit, which will be described in detail later.

In the path 61, the thermostat 30 is disposed at the upstream end, the downstream end is connected to the four-way valve 40, and EWP 12 and the engine 10 are disposed on the way. The path 62 has an upstream end connected to the four-way valve 40, a downstream end connected to the thermostat 30, and a heater core 20, a HWP 22, and a heater 24 disposed on the way. The path 61 and the path 62 are examples of circulation paths through which the coolant circulates between the engine 10 and the heater core 20 when the communication state is established by the four-way valve 40. The path 63 has an upstream end connected between the heater 24 of the path 62 and the thermostat 30, and a downstream end connected to the four-way valve 40. The path 64 has an upstream end connected between the engine 10 and the four-way valve 40 of the path 61, and a downstream end connected between the heater 24 and the thermostat 30 of the path 62. The temperature sensor 18 is provided at a portion where the path 61 and the path 64 are connected to each other. The path 64 is an example of a bypass path in which the coolant that is connected to the paths 61 and 62 and has passed through the engine 10 bypasses the heater core 20 and flows into the engine 10 again. The upstream end of the path 65 is connected to the four-way valve 40, the downstream end is connected between the heater core 20 and HWP 22 of the path 62, and the heat-exchanger 50 is disposed on the way. The upstream end of the path 66 is connected between the engine 10 of the path 61 and the temperature sensor 18, the downstream end is connected to the thermostat 30, and the radiator 14 and the reserve tank 16 are disposed on the way. The path 66 is an example of a radiator path.

4-Way Valve

Figure 2A:
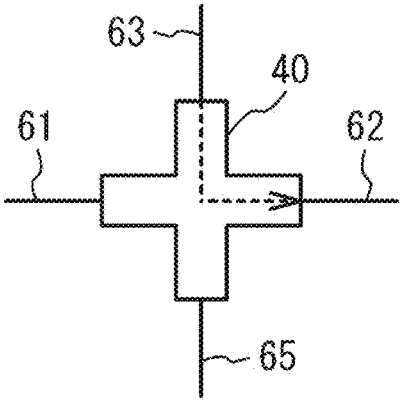
FIG. 2A is an explanatory view of a communication condition of the four-way valve.
Figure 2B:
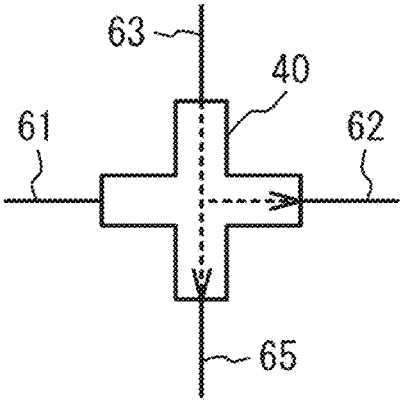
FIG. 2B is an explanatory view of a communication condition of the four-way valve.

Next, the four-way valve 40 will be described. FIG. 2A to FIG. 2F is an explanatory view of a communication condition of the four-way valve 40. As the rotor of the four-way valve 40 rotates in one direction, the communication status is switched from FIG. 2A to FIG. 2F. In FIG. 2A, the path 63 and the path 62 are in communication with each other, and the paths 61 and 65 are blocked. In this condition, EWP 12 is stopped and HWP 22 is driven. The coolant circulates through the heater core 20 and the heater 24 via a part of the path 62 and the path 63. The opening degree of the opening communicating the path 63 and the path 62 of the four-way valve 40 is maximum. In FIG. 2A, the rotor of the four-way valve 40 is in the initial position. As the rotor rotates in one direction from the initial position, the opening degree of the opening communicating the path 63 and the path 62 decreases, and as shown in FIG. 2B, the opening degree of the opening communicating the path 63 and the path 65 increases.

In FIG. 2B, the path 63 communicates with the paths 62 and 65, and the path 61 is blocked. In this condition, EWP 12 is stopped and HWP 22 is driven. The coolant circulates through the heater core 20 and the heater 24 via a part of the path 62 and the path 63, and circulates through the heat exchanger 50 via the path 65. As the rotor rotates in one direction from FIG. 2B, the opening degree of the opening in communication between the path 63 and the path 62 decreases to zero as shown in FIG. 2C, and the opening degree of the opening in communication between the path 63 and the path 65 increases to the maximum.

Figure 2C:
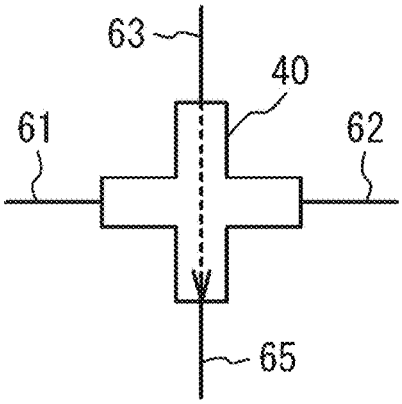
FIG. 2C is an explanatory view of a communication condition of the four-way valve.

In FIG. 2C, the path 63 and the path 65 communicate with each other, and the path 61 and the path 62 are blocked. In this condition, EWP 12 is stopped and HWP 22 is driven. The coolant circulates through the heat exchanger 50 and the heater 24 via a portion of the path 62, the path 63, and the path 65. The opening degree of the opening communicating the path 63 and the path 65 of the four-way valve 40 is maximum. As the rotor rotates in one direction from FIG. 2C, the opening degree of the opening communicating the path 63 and the path 65 decreases as shown in FIG. 2D, and the opening degree of the opening communicating the path 61 and the path 62 increases.

Figure 2D:
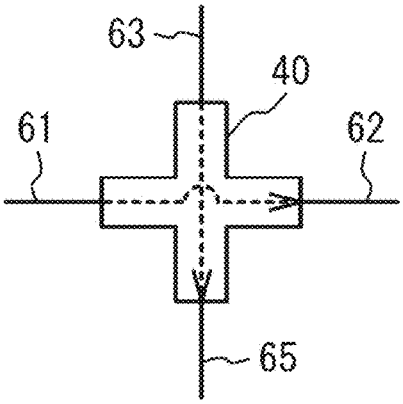
FIG. 2D is an explanatory view of a communication condition of the four-way valve.

In FIG. 2D, the path 63 communicates with the path 65, and the path 61 and the path 62 communicate with each other. The paths 63 and 65 do not communicate with the paths 61 and 62. In this condition, EWP 12 and HWP 22 are driven. The coolant circulates through the heat exchanger 50 and the heater 24 via a portion of the path 62, the path 63, and the path 65, and circulates through the engine 10, the heater core 20, and the heater 24 via the paths 61 and 62. Accordingly, the paths 61 and 62 correspond to a path through which the coolant having passed through the engine 10 passes through the engine 10 again without passing through the radiator 14. When the thermostat 30 is in the fully opened state, the coolant also circulates to the radiator 14 and the reserve tank 16 via the path 66. As the rotor rotates in one direction from FIG. 2D, the opening degree of the opening communicating the path 63 and the path 65 decreases to zero as shown in FIG. 2E, and the opening degree of the opening communicating the path 61 and the path 62 increases to the maximum.

Figure 2E:
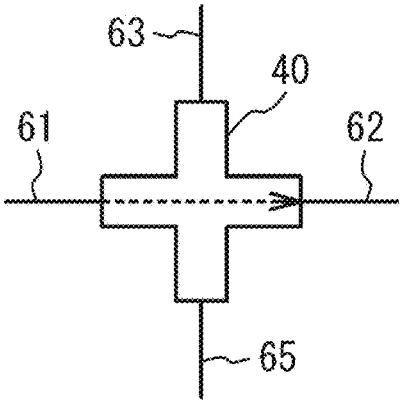
FIG. 2E is an explanatory view of a communication condition of the four-way valve.

In FIG. 2E, the path 61 and the path 62 are in communication with each other, and the paths 63 and 65 are blocked. In this condition, at least EWP 12 is driven. The coolant circulates through the engine 10, the heater core 20, and the heater 24 via the paths 61 and 62. The opening degree of the opening communicating the path 61 and the path 62 of the four-way valve 40 is maximum. When the thermostat 30 is in the fully opened state, the coolant also circulates to the radiator 14 and the reserve tank 16 via the path 66. As the rotor rotates in one direction from FIG. 2E, the opening degree of the opening communicating the path 61 and the path 62 decreases as shown in FIG. 2F, and the opening degree of the opening communicating the path 61 and the path 65 increases.

Figure 2F:
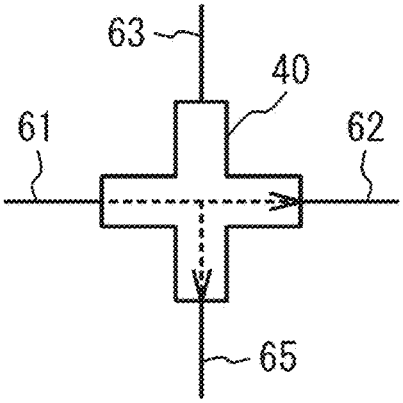
FIG. 2F is an explanatory view of a communication condition of the four-way valve.

In FIG. 2F, the path 61 communicates with the paths 62 and 65, and the path 63 is blocked. The coolant circulates through the engine 10, the heater core 20, the heater 24, and the heat exchanger 50 via the path 61, the path 62, and the path 65 by at least EWP 12. Accordingly, the paths 61, 62, and 65 are examples of circulation paths through which the coolant circulates between the engine 10 and the heater core 20 when these paths are brought into communication with each other by the four-way valve 40. When the thermostat 30 is in the fully opened state, the coolant also circulates to the radiator 14 and the reserve tank 16 via the path 66.

The sum of the opening degree of the opening communicating the path 61 and the path 62 in FIG. 2F and the opening degree of the opening communicating the path 61 and the path 65 is lower than the largest value of the opening degree of the opening communicating the path 61 and the path 62 in FIG. 2E. For example, the opening degree of the opening communicating the path 61 and the path 62 in FIG. 2E is set to 100%. In FIG. 2F, the opening degree of the opening communicating between the path 61 and the path 62 is 40%, and the opening degree of the opening communicating between the path 61 and the path 65 is 40%. Therefore, the opening degree of the path 61 in FIG. 2F is 80%, which is lower than the opening degree of 100% in FIG. 2E.

Therefore, the opening degree of the opening that communicates the path 61 and the path 62 in FIG. 2C increases from the zero-state to the state of FIG. 2D. Next, the opening degree of the opening communicating the path 61 and the path 62 is maximized to be in FIG. 2E. Next, the opening degree of the opening that communicates the path 61 with the paths 62 and 65 gradually decreases to be in FIG. 2F. ECU 100 obtains the opening degree of such a path by referring to a map defined according to the target rotational position of the rotor. The four-way valve 40 is an example of an on and off valve.

Thermostat

Figure 3A:
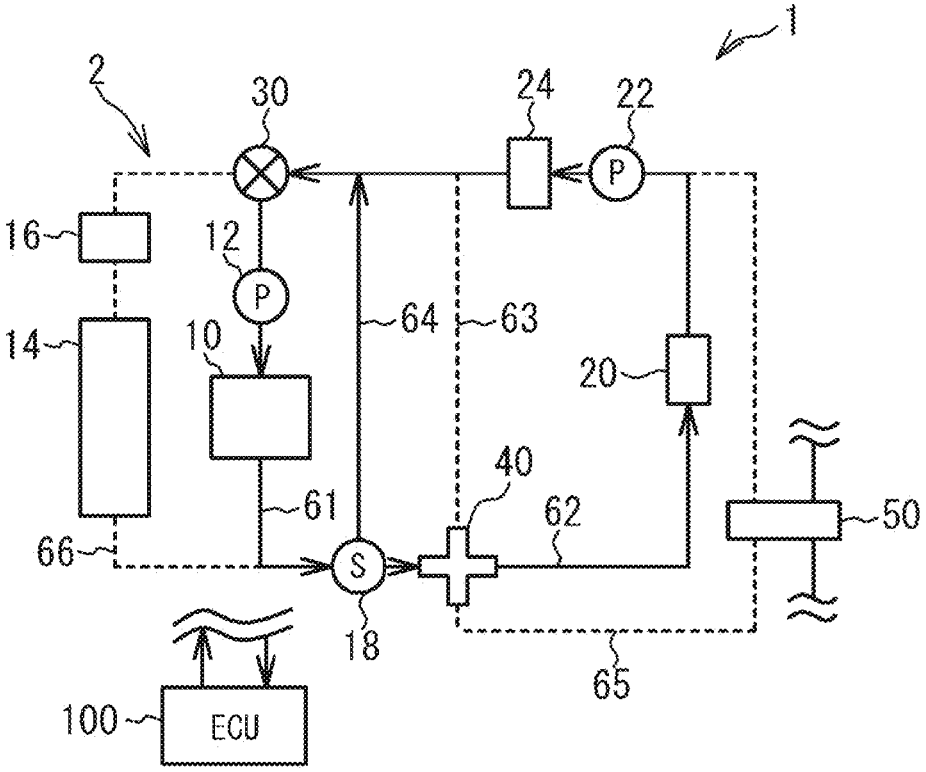
FIG. 3A is an explanatory view of a flow path of the coolant when the thermostat is fully closed.

Next, the fully closed state and the fully open state of the thermostat 30 will be described. FIG. 3A is an explanatory diagram of a flow path of the coolant when the thermostat 30 is fully closed. FIG. 3A shows that the four-way valve 40 communicates the path 61 and the path 62 and blocks the paths 63 and 65. The coolant flows through EWP 12, the engine 10, the four-way valve 40, the heater core 20, HWP 22, the heater 24, and the thermostat 30 in this order. coolant flows from the temperature sensor 18 toward the path 62 in the path 64. Since the thermostat 30 is in the fully closed state, the coolant does not flow to the radiator 14, and warm-up of the engine 10 is achieved.

Figure 3B:
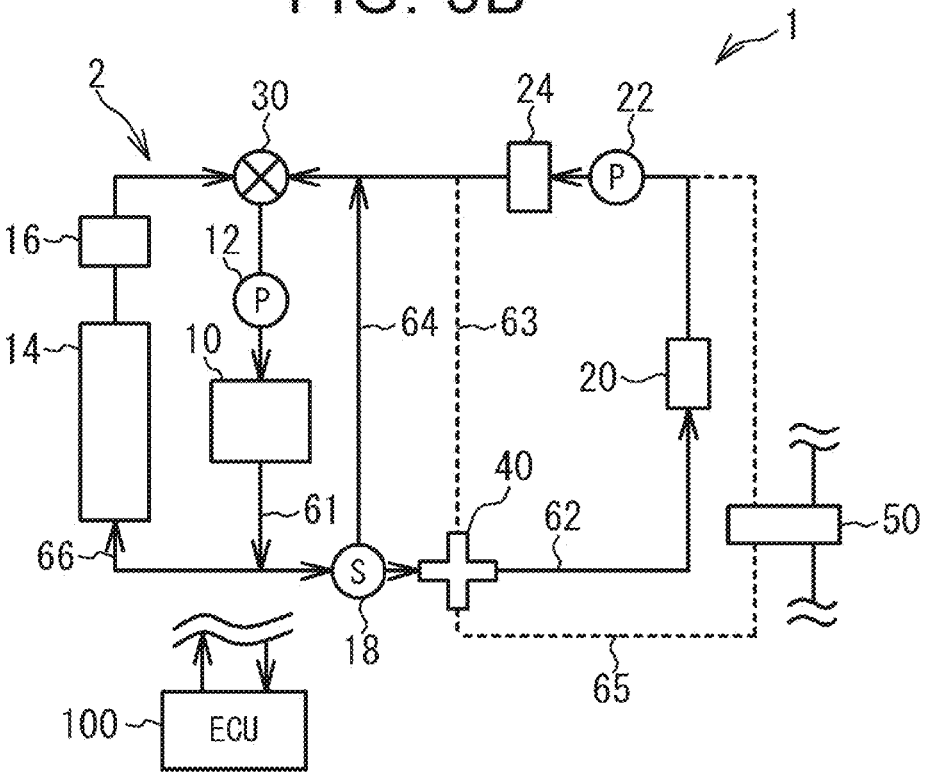
FIG. 3B is an explanatory view of a flow path of the coolant when the thermostat is fully opened.

FIG. 3B is an explanatory diagram of a flow path of the coolant when the thermostat 30 is fully opened. FIG. 3B also shows that the four-way valve 40 communicates the path 61 with the path 62 and shuts off the paths 63 and 65 as in FIG. 3A. Part of the coolant that has passed through the engine 10 flows through the path 62 to the heater core 20, and the remainder of the coolant that has passed through the engine 10 flows through the path 66 to the radiator 14. In addition, the coolant that has passed through the heater core 20, HWP 22, and the heater 24 via the path 62 flows into the thermostat 30. Further, the coolant that has passed through the radiator 14 and the reserve tank 16 via the path 66 also flows into the thermostat 30. The coolant flowing into the thermostat 30 from both directions in this manner flows through EWP 12 and the engine 10 via the path 61. As described above, a part of the coolant is also made to flow to the radiator 14, so that the increase in the temperature of the coolant is suppressed.

EWP Drive Starting Control

Figure 4:
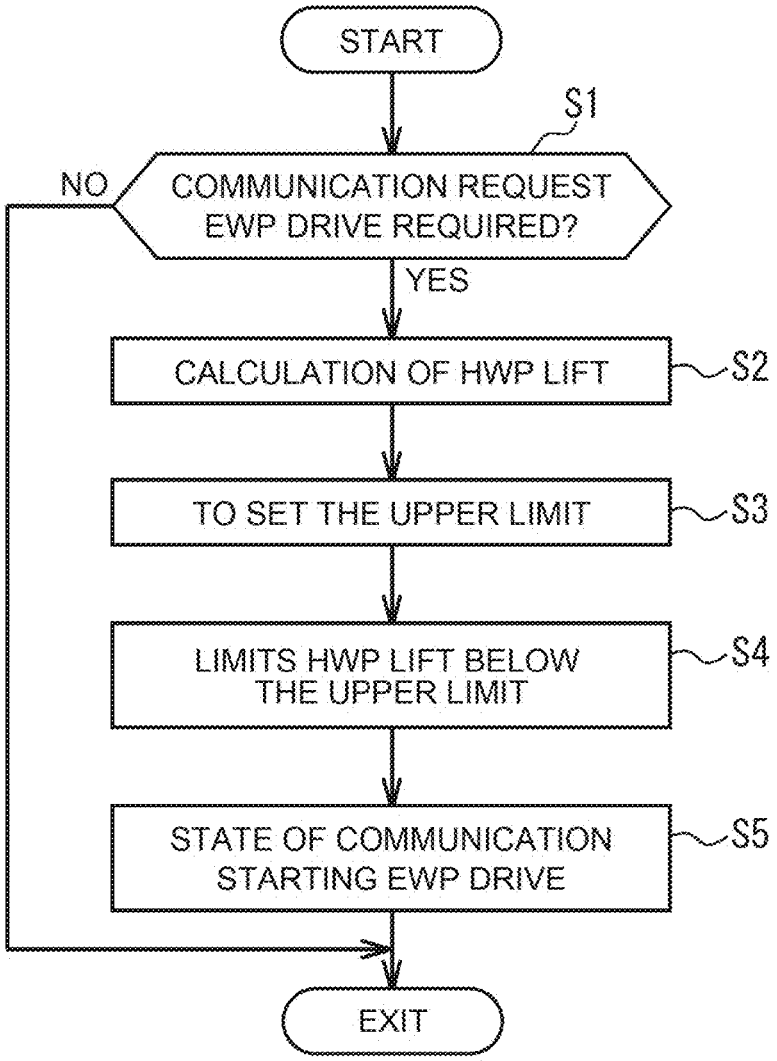
FIG. 4 is a flow chart exemplifying the drive starting control of EWP executed by ECU.

FIG. 4 is a flow chart exemplifying the drive starting control of EWP 12 executed by ECU 100. ECU 100 determines whether there is a communication request between the path 61 and the path 62, or a communication request between the path 61, the path 62, and the path 65, and there is an EWP 12 driving request (S1). The above communication request is a request that the four-way valve 40 is in communication with FIG. 2D to FIG. 2F. The communication state is a state in which the coolant conveyed by HWP 22 flows through EWP 12. If S1 is No, this control ends.

Figure 5:
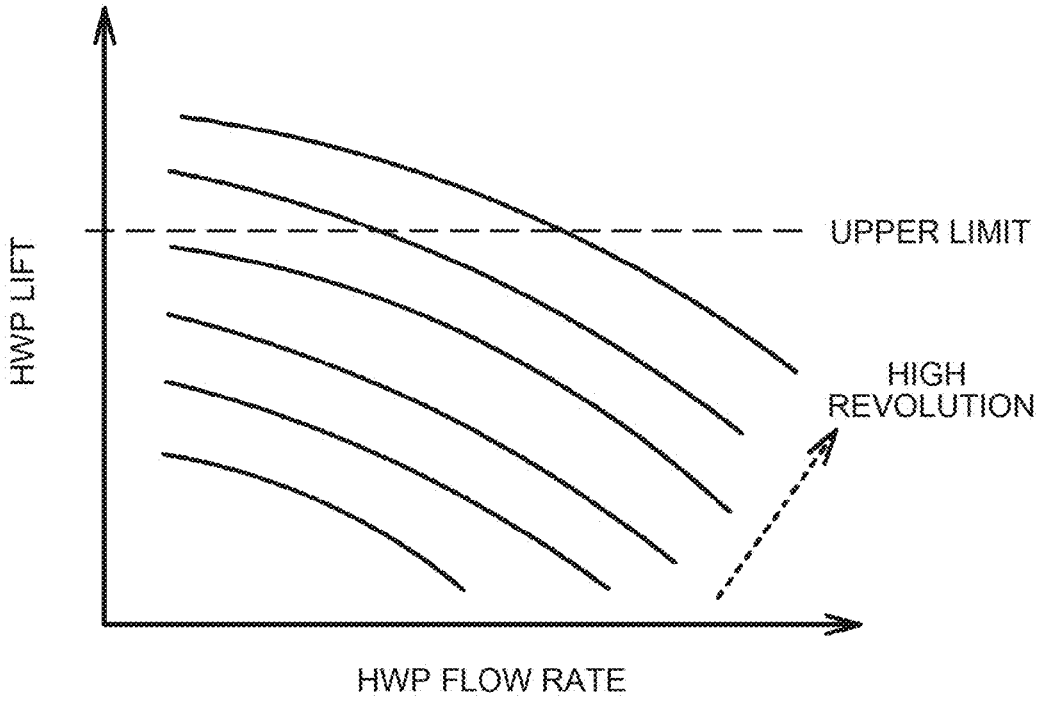
FIG. 5 is a map defining the relation between the lift of HWP and the flow rate of coolant passing through HWP and the rotational speed of HWP.

If S1 is Yes, ECU 100 refers to the map of FIG. 5 to calculate the lift [kPa] of HWP 22 (S2). FIG. 5 is a map that defines the relation between the lift of HWP 22 and the flow rate [L/min] of the coolant passing through HWP 22 and the rotational speed [rpm] of HWP 22. The map of FIG. 5 is defined based on experimental results and simulation results. As shown in FIG. 5, the lower the flow rate of the coolant passing through HWP 22 and the higher the rotational speed of HWP 22, the higher the lift of HWP 22. ECU 100 refers to the map of FIG. 5 and calculates the lift of HWP 22 based on the target flow rate of the coolant passing through HWP 22 and the target rotational speed or the indicated rotational speed. As the lift of HWP 22 increases, the flow rate of the coolant passing through FIG. 2D increases due to the driving of HWP 22 in a state where FIG. 2D to FIG. 2F is in communication and EWP 12 is stopped. Instead of the map shown in FIG. 5, the lift of HWP 22 may be calculated by an arithmetic expression using the flow rate of the coolant passing through HWP 22 and the rotational speed of HWP 22 as arguments.

Next, ECU 100 sets an upper limit value for limiting the lift of HWP 22, which will be described later referring to the map of FIG. 6, based on the opening degree of the thermostat 30 and the opening degree of the path 61 (S3). The upper limit value is set to the upper limit value of the lift of HWP 22 that can prevent the step-out of EWP 12 when the driving of EWP 12 is started in communication with the FIG. 2D to FIG. 2F. S3 is an exemplary process executed by the setting unit.

Figure 6:
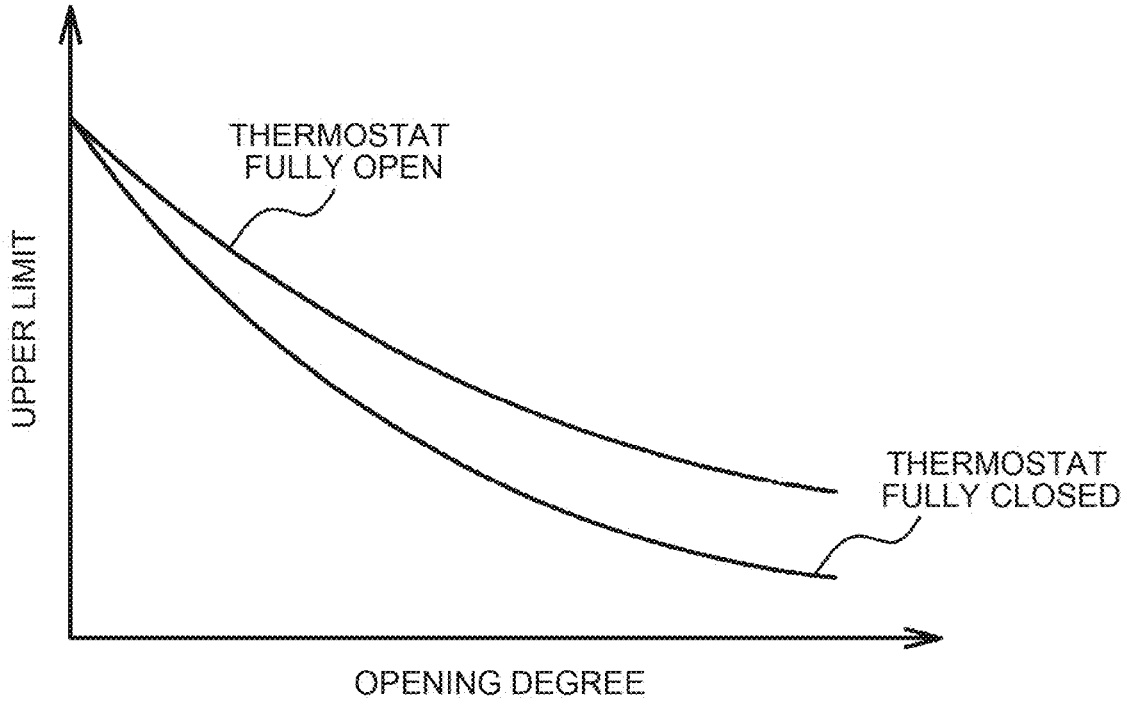
FIG. 6 is a map that defines the relationship between the state of the thermostat, the opening degree of the path, and the upper limit value.

FIG. 6 is a map that defines the relationship between the state of the thermostat 30, the opening degree of the path 61, and the upper limit value. In FIG. 6, the upper limit value is defined between the case where the thermostat 30 is in the fully closed state and the case where the thermostat is in the fully opened state. The map of FIG. 6 is defined based on experimental results and simulation results. As shown in FIG. 6, the upper limit value is set to a lower value than in the case where the thermostat 30 is in the fully opened state in the fully closed state. This is because when the thermostat 30 is in the fully-closed state, the volume of the entire path through which the coolant flows is smaller than that in the fully-opened state, and EWP 12 is received from the coolant conveyed from HWP 22. As shown in FIG. 6, the upper limit value is set to a higher value as the opening degree of the path 61 is smaller. This is because the pressure drop of the coolant increases as the opening degree of the path 61 decreases, and the pressure received by EWP 12 from the coolant conveyed from HWP 22 decreases. Further, as shown in FIG. 6, the difference between the upper limit values in the case where the thermostat 30 is in the fully opened state and in the fully closed state decreases as the opening degree of the path 61 decreases. This is because the smaller the opening degree of the path 61, the smaller the effect of the condition of the thermostat 30 on the pressure experienced by EWP 12.

ECU 100 estimates the opening degree of the thermostat 30 based on, for example, the temperature of the coolant detected by the temperature sensor 18. The opening degree of the path 61 is estimated by ECU 100 in accordance with the target rotational position of the rotor of the four-way valve 40 in the communication requirement in S1. In the map of FIG. 6, the upper limit value changes continuously with respect to the opening degree of the path 61, but may change stepwise. Instead of the map of FIG. 6, the upper limit value may be calculated by an arithmetic expression using the opening degree of the thermostat 30 and the opening degree of the path 61 as arguments.

ECU 100 then (S4) the lift of HWP 22 below the upper limit. Specifically, when the calculated lift of HWP 22 exceeds the upper limit value, ECU 100 lowers the rotational speed of HWP 22 to a rotational speed at which the lift of HWP 22 becomes equal to or lower than the upper limit value. The step-out of EWP 12 means that the position of the rotor of EWP 12 deviates from the desired position due to external force from the coolant caused by the lift of HWP 22 of the impeller. Due to the step-out of EWP 12, it is difficult to accurately control the position of the rotor of EWP 12, and the controllability of EWP 12 may deteriorate. S4 is an exemplary process executed by the first control unit.

ECU 100 then controls the four-way valve 40 in accordance with S1 communication requirements to bring it into communication with any of FIG. 2D to FIG. 2F and initiate (S5) of EWP 12. In this way, EWP 12 is started to be driven in a communication state in a state where the lift of HWP 22 is limited to the above-described upper limit or less. Therefore, the step-out of EWP 12 is suppressed, and a decrease in the controllability of EWP 12 is also suppressed. S5 is an exemplary process executed by the second control unit.

Further, as described above, the upper limit value is set in accordance with the fully opened and fully closed states of the thermostat 30 and the opening degree of the path 61. For this reason, the upper limit is set to be high as long as the step-out of EWP 12 can be suppressed, and HWP 22 can be prevented from being excessively restricted.

The higher the rotational speed of HWP 22, the higher the lift of HWP 22. Therefore, the rotational speed of HWP 22 is a correlation value of the lift. Therefore, for example, the rotational speed of HWP 22 may be limited to be equal to or lower than the upper limit that can prevent the step-out of EWP 12 when the driving of EWP 12 is started in communication with FIG. 2D to FIG. 2F.

Although the embodiments of the present disclosure have been described in detail above, the present disclosure is not limited to such specific embodiments, and various modifications and changes can be made within the scope of the gist of the present disclosure described in the claims.

What is claimed is:

1. An engine cooling system, comprising:

a cooling circuit including a circulation path through which coolant circulates between an engine and a heater core for heating, by an engine water pump that causes coolant to flow to the engine and a heater core water pump that causes coolant to flow to the heater core; and a control device that controls the engine water pump and the heater core water pump, wherein the control device includes a first control unit for controlling the heater core water pump such that a correlation value that is correlated with lift of the heater core water pump is no greater than an upper limit value at which step-out of the engine water pump is suppressible when a drive request is made for the engine water pump in a stopped state, and a second control unit that starts driving the engine water pump in a state in which the heater core water pump is controlled such that the correlation value is no greater than the upper limit value.

2. The engine cooling system according to claim 1, wherein the cooling circuit includes a radiator path that communicates with the circulation path and through which coolant from the engine is made to flow to a radiator without passing through the heater core, and a thermostat that is provided on the radiator path, the control device includes a setting unit for setting the upper limit value, and when the thermostat is in a fully closed state, the setting unit sets the upper limit value to a lower value than when the thermostat is in a fully open state.

3. The engine cooling system according to claim 2, wherein the cooling circuit includes an on and off valve that adjusts an opening degree of the circulation path, and the setting unit sets the upper limit value to a higher value as the opening degree is smaller.

* * * * *